United States Patent [19]

Warren

[11] 4,041,838

[45] Aug. 16, 1977

[54] VALVE ARRANGEMENTS FOR RECIPROCATING PISTON MACHINES

[76] Inventor: Glenn B. Warren, 1361 Myron St., Schenectady, N.Y. 12309

[21] Appl. No.: 632,316

[22] Filed: Nov. 17, 1975

[51] Int. Cl.[2] ..... F01L 15/16

[52] U.S. Cl. ..... 91/273; 251/55

[58] Field of Search ..... 91/273, 265, 266, 267, 91/268, 269, 270, 271, 272; 251/55, 54

[56] References Cited

U.S. PATENT DOCUMENTS

| | | | |
|---|---|---|---|
| 859,371 | 7/1907 | Coyle | 251/54 |
| 2,051,534 | 8/1936 | Skwierowski | 91/273 |
| 2,671,434 | 3/1954 | Schmiedeskomp | 91/273 |
| 3,064,675 | 11/1962 | Johnson et al. | 251/54 |
| 3,638,533 | 2/1972 | Sheridon et al. | 91/273 |

*Primary Examiner*—Paul E. Maslousky
*Attorney, Agent, or Firm*—Joseph V. Claeys

[57] ABSTRACT

A valve arrangement for controlling the flow of fluid from an inlet passage to the cylinder of a reciprocating piston engine wherein the valve is opened by a cam against the resistance of a valve closing spring and compressed gas above a plunger connected to the end of the valve stem and slidingly positioned within an enclosed chamber and which valve closing spring and compressed gas provide the forces for effecting rapid closing of the valve.

11 Claims, 1 Drawing Figure

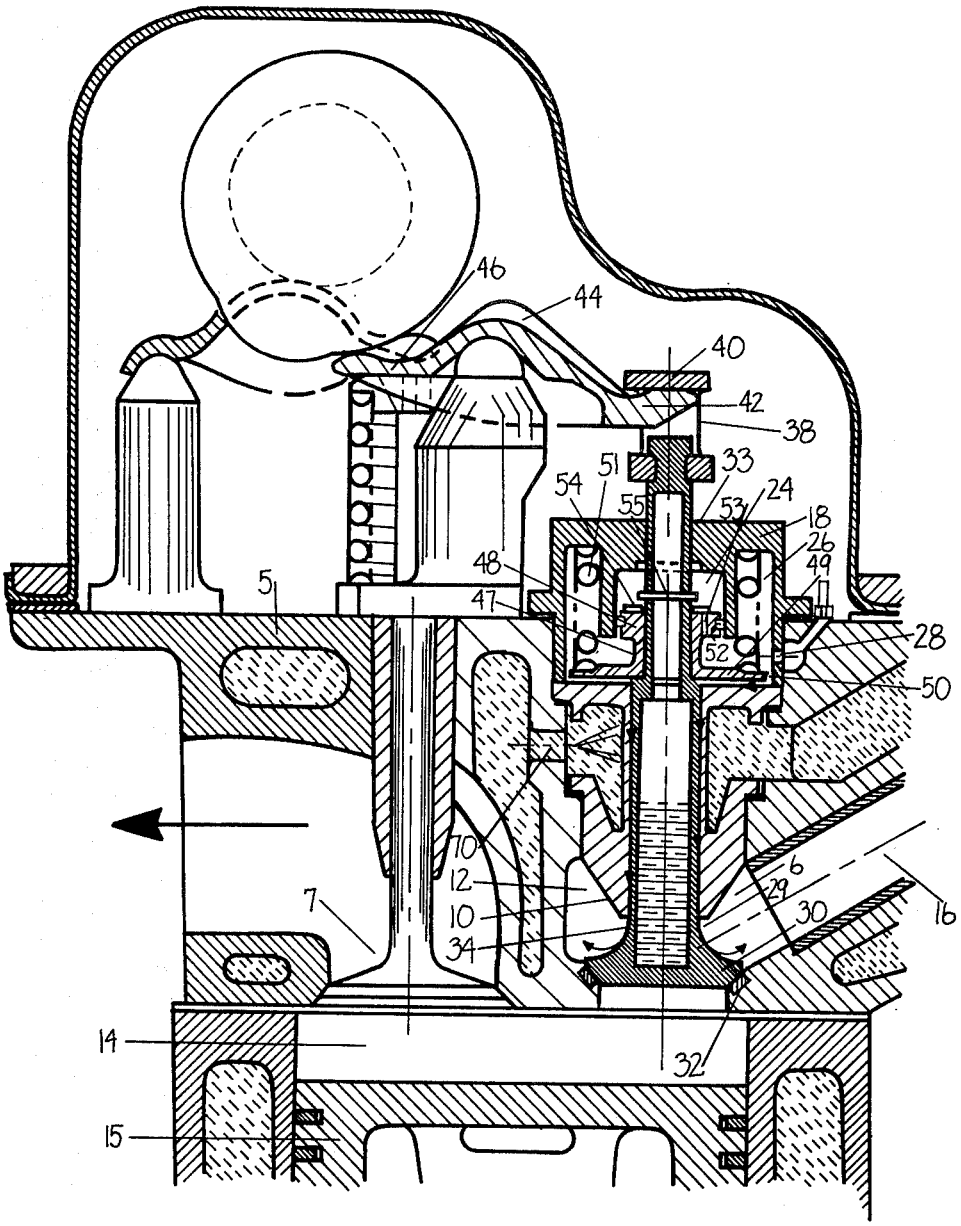
46
44
40
42
38
33
51
54
55
53
24
18
26
49
48
47
5
52
28
50
70
12
10
34
7
6
29
30
16
14
32
15

VALVE ARRANGEMENTS FOR RECIPROCATING PISTON MACHINES

BACKGROUND OF THE INVENTION

This invention relates to valve arrangements for controlling the flow of fluids, particularly high temperature inlet fluids of reciprocating piston engines.

While this invention has a wide range of applications, it is especially useful in controlling the flow of high temperature fluids in reciprocating engines employing external combustion systems of the type disclosed in Warren's U.S. Pat. No. 3,577,729; consequently, it will be described in detail in connection with that engine.

Air pollution has become a major problem in the United States and other highly industrialized countries of the world. There is ample evidence that major contributors to this pollution are automobiles employing the conventional internal combustion, reciprocating piston engines.

The new and improved engine of Warren's U.S. Pat. No. 3,577,729, while retaining many of the basic structural features of the conventional mass produced, internal combustion engine, provides greater fuel economy and exhibits substantially lower level of basic pollutants (CO, HC, $NO_x$) because it employs a stable, controlled, external combustion system. The analysis and calculations show that the most restrictive federal emission requirements are fully met even by a high performance new engine and even in a vehicle weighing up to 5000 pounds.

The use of an external combustion system subjects at least some of the valve means to operating conditions different from those of the conventional engine so that some of such conventional valve arrangements may not be entirely satisfactory for use with an engine such as that described in Warren's U.S. Pat. No. 3,577,729. For example, the typical cam-type valve arrangement may not be entirely satisfactory for controlling the flow of the high temperature combustion products from the external combustion system into the engine cylinders for expansion therein to drive the pistons in well known manner. This is because for high efficiency the inlet valve should open near top dead center and close at 45° to 50° after top dead center. This means rapid action.

The prior art valve arrangements of the conventional internal combustion engines are typically of the type which are opened by a cam against the resistance of a valve closing spring. For example, for high engine efficiency in an engine such as that of the Warren patent the inlet valve should open near the top dead center position of the piston and should close at 45° to 50° after top dead center which requires rapid valve action. In order to achieve the required rapid closing of such valve to control efficiently the flow of the high temperature gas from the external combustion system to the engine cylinder of the type shown in Warren's U.S. Pat. No. 3,577,729, it may be necessary to use a custom made, exceedingly strong, valve spring. The use of such a strong valve spring is undesirable not only because the spring itself is more costly, but also because it results in high inertias and great stress on the entire valve train. The combination of these factors results in increased valve cost, as well as overall increased costs and complexity of the engine.

It is an object of this invention, therefore, to provide a valve arrangement for controlling the flow of high temperature fluids which overcomes one or more of the foregoing described difficulties.

It is another object of the invention to provide a valve arrangement for controlling the flow of fluids which is simple, reliable and low in cost.

It is still another object of the invention to provide a fast acting, low cost, reliable valve arrangement for controlling the flow of fluids which obviates the need for a massive valve spring.

It is a further object of the invention to provide a fast acting valve arrangement for an engine which is simple, reliable and of low cost and allows for simplification of the engine design and consequent reduction in engine production costs.

It is a still further object of the invention to provide a fast acting valve arrangement for controlling the flow of fluids which includes means to dampen or cushion the force of impact as the valve is closed.

SUMMARY OF THE INVENTION

Briefly stated in accordance with one aspect of the invention, there is provided a valve arrangement for controlling the flow of fluid from an inlet passage to an engine working cylinder having a piston reciprocally positioned therein. A valve having a head and a stem extending therefrom is arranged to be opened by a cam against the resistance of a valve-closing means which means comprises the combination of a relatively light valve spring means and a plunger means operatively associated with the valve stem and slidingly positioned in an enclosed chamber adjacent the outer end of the valve stem and operative to compress the fluid in the chamber above the plunger so that the combined forces of the spring means and the compressed fluid are effective at the proper time to actuate the valve to its closed position.

BRIEF DESCRIPTION OF THE DRAWING

The sole FIGURE shows an elevational sectional view of the valve arrangement which is opened by cam assembly and closed by combined means of a spring and gas compressed in a chamber surrounding the end of the valve stem; only the parts of the engine which are pertinent in describing the working of the valve are illustrated.

DETAILED DESCRIPTION

The sole FIGURE of the drawing illustrates one embodiment of the invention incorporated in an external combustor, reciprocating piston engine of the type described in Warren U.S. Pat. No. 3,577,729. The valve arrangement of the invention is employed to control the flow of the high temperature fluids from the combustor to the expansion cylinder of a reciprocating piston engine. An important feature of the valve arrangement of the present invention is that movement of the valve head to open the inlet passage is away from the engine piston, whereas in the usual internal combustion engine arrangements the valve head moves toward the piston. This is important since in an engine such as that described in Warren U.S. Pat. No. 3,577,729, the cylinder head to piston clearance remains small for reasons of efficiency so that failure in the cam closing of the discharge valve or opening of the inlet valve could result in very high pressure above the piston with possible resulting engine damage. Such a condition is not possible with the valve arrangement of this invention since any such pressure build-up tends to open the valve.

As illustrated in the drawing, an engine cylinder head 5 is provided with suitable inlet and discharge valve arrangements, shown generally by the reference numerals 6 and 7 respectively, for controlling the flow of fluid into and out of the expansion cylinder of a reciprocating piston engine. The inlet valve arrangement 6 is constructed in accordance with the present invention. The discharge valve arrangement may be of any suitable type and is illustrated as being of the conventional type which is opened by a cam against the resistance of a valve closing spring.

As shown in the drawing, inlet valve arrangement 6 includes a valve guide 10 extending into an inlet passage 12 which in turn communicates at one end with the expansion cylinder 14 of the engine and at the other end with an outlet manifold passage 16 of an external combustion system (not shown).

A housing 18 having an inner bore and an outer bore surrounds the outer end of valve guide 10 and is secured to the cylinder head 5 in any suitable manner. When so secured, housing 18 defines two concentric enclosed cylinders, an inner cylinder 24 and an outer cylinder 26.

Outer cylinder 26 communicates with an opening 28 which is in turn adapted to be connected with a suitable source of compressed fluid, such as the output of the compression means which supplies compressed air to the inlet end of the external combustion system.

A valve 29 has a head 30 arranged to mate with a valve seat 32 of the inlet passage 12. Valve 29 also has a stem 34 extending from the head 30, through valve guide 10 and through a central opening 33 in the top of the housing 18. Valve 29 is arranged to be actuated between open and closed positions with respect to valve seat 32 to control the flow of fluid from the external combustion system to the expansion cylinder 14 of the engine.

In accordance with this invention, means are provided to actuate valve 29 between its open and closed positions in a simple and reliable manner and in accordance with the opening requirements of the engine. To this end, the outer end of valve stem 34 has mounted thereon a holder 38 having the flat surface below a cylindrical lip 40 adapted to fit inside the bifurcated end 42 of a rocker arm 44. The other end 46 of rocker arm 44 is adapted to ride on the surface of a suitable cam.

Within housing 18 valve stem 34 also carries a member 47 which terminates at one end in a plunger 48 slidingly disposed within the inner cylinder 24. Member 47 terminates at its other end in an annular plate 49. The diameter of plate 49 is slightly smaller than the inside diameter of the outer cylinder 26 such that the annular plate 49 defines a small annular passage 50. A spring means 51 is disposed in outer cylinder 26 and is retained therein between the top of the cylinder 26 and the annular plate 49.

Plunger 48 is provided with suitable sealing means 52 to effect the desired sealing between the plunger 48 and the walls of the inner cylinder 24. There will, of course, be some leakage past sealing means 52, however, this leakage will be greater at the lower engine speeds and loads when the rate of valve opening and closing is lower. This is a desirable effect since it automatically provides for less valve closing gas pressure at lower engine speeds and loads and a greater valve closing gas pressure at the higher engine speeds and loads. If desired the arrangement may be provided with a controlled leakage path which again will automatically allow more leakage at the lower speeds and loads. Plunger 48 also has a passage 53 therein which provides communication between the outer cylinder 26 and the inner cylinder 24. A washer 54, loosely disposed about the valve stem 34 provides a check valve means to permit the flow of fluid from the outer cylinder 26 into the inner cylinder 24 whenever the pressure in the outer cylinder exceeds the pressure in the inner cylinder 24. To control the amount of movement of washer 54, a suitable limiting means, shown as a ring 55, is disposed on valve stem 34 a preselected distance above the check valve washer 54.

In operation, at a predetermined time the high part of the cam causes the end 46 of the rocker arm 44 to be moved downward so that the end 42 connected with the valve stem pushes upward against the cylindrical lip 40 of the holder 38 affixed to valve stem 34. The force transmitted by the rocker arm 44 is sufficient to overcome the force exerted by the spring 51 and the force required to compress the fluid above plunger 48, thereby lifting the valve 29 into the open position. The impact of opening of the valve 29 is also damped by the resistance of the air compressed in the inner cylinder 24 by the plunger 48 moving with the valve 29. When the valve 29 opens the passage 12, the combustion gases enter the expansion cylinder 14 and force the piston 15 downward in a power stroke. As the end 46 of the rocker arm 44 moves onto the low side of the cam the end 42 of rocker arm 44 is lowered. The upward force on the valve stem is thus released and the force of the spring 51 together with the force of the fluid compressed in the inner cylinder 24 cause the valve 29 to close rapidly. The impact of the closing is cushioned by the shape of the cam and by the resistance of the air trapped below the annular plate 49.

Cooling of the valve is provided by forcing cool compressed air from the compression cylinder (not shown) through the bore 28 and into the outer cylinder 26. The air is then directed to flow downward between the valve guide 10 and the valve stem 34. The cool compressed air is at a higher pressure than that of the combustion gases from the external combustion system; consequently, it not only cools the valve as it flows downward but it also keeps the hot combustion gases away from the head 30 of the valve 29 and prevents entry of the hot gases into the space between the valve guide 10 and valve stem 34.

For high temperature applications the valve 29 may be of the cooled type wherein the valve stem is hollow and contains a selected amount of Sodium or other suitable material. The valve guide 10 is also cooled by circulating cooling fluid in the cooling passages and forcing such cooling fluid under pressure through small apertures in the jacket wall 70 into the region adjacent the valve guide 10.

While only a preferred embodiment of the invention has been shown and described by way of illustration, many changes and modifications will occur to those skilled in the art. It is, therefore, to be understood that the appended claims are intended to cover all such changes and modifications as fall within the true spirit and scope of the invention.

What is claimed as new and desired to be secured by Letters Patent of the United States is:

1. In a reciprocating piston machine wherein inlet and discharge valve means control the flow of fluid into and out of a working cylinder of said machine in a desired timed sequence, the combination with said machine of an improved inlet valve arrangement comprising:

a. an inlet valve having a head and a stem extending therefrom;

b. a housing member surrounding a portion of said stem and defining enclosed cavity means having first and second concentric inner and outer cylindrical bores adjacent said cylinder;

c. plunger means carried by said valve stem and within said enclosed housing means, said plunger means including a first portion disposed in sealed working relationship with the inner smaller diameter one of said cylindrical bores to define a sealed gas containing space above said first portion and a second portion within and near the bottom of said enclosed housing means, said second portion having a diameter smaller than the inside diameter of said outer larger diameter one of said cylindrical bores to define a small annular passage therewith;

d. a valve spring disposed within said larger diameter cylindrical bore and arranged therein and with said second portion of said plunger means to urge said valve to its closed position; and e. valve actuating means including a rotary cam means driven in timed relationship with said machine and a pivotally mounted rocker arm means operatively associated with said cam means and with said inlet valve for actuating said inlet valve to its open position at the desired time in a direction away from said cylinder against the combined resistances of said valve closing spring and the gas compressed in said gas containing space by said first portion of said plunger means and for releasing said valve to be actuated to its closed position at the desired time by the combined forces of said valve spring and said compressed gas.

2. The improved inlet valve arrangement recited in claim 1 including means for supplying gas under pressure to said enclosed cavity means and a check-valved passage means communicating said larger diameter cylindrical bore with said smaller diameter cylindrical bore.

3. The improved inlet valve arrangement recited in claim 2 wherein said check-valved passage means is located in said first portion of said plunger means.

4. The improved inlet valve arrangement recited in claim 1 wherein said second plunger portion and the small annular passage are operative to provide damping of the impact of the closing of said valve.

5. The improved inlet valve arrangements recited in claim 1 including means for supplying gas under pressure to said enclosed cavity means which flows along said valve stem to prevent the fluid being supplied to said cylinder from flowing upward along said valve stem and provide cooling for said valve.

6. The improved inlet valve arrangement of claim 5 wherein said gas under pressure is supplied to the larger diameter one of said bores and a check-valved passage means effects communication between said first and second cylindrical bores when the pressure in said smaller diameter bore is lower than that in said larger diameter bore.

7. In a reciprocating piston machine wherein inlet and discharge valve means control the flow of fluid into and out of a working cylinder of said machine in a desired timed sequence, the combination with said machine of an improved inlet valve arrangement comprising:

a. an inlet valve having a head and a stem extending therefrom;

b. a housing means surrounding a portion of said stem and defining first and second separate concentric enclosed cylindrical cavities and adjacent said cylinder, said first cylindrical cavity having a larger diameter than that of said second cylindrical cavity;

c. a valve spring disposed within said first larger diameter cylindrical cavity and operatively arranged therein and with said valve to urge said valve to its closed position;

d. a plunger carried by said valve stem remote from said head and working in sealed relationship in said second smaller diameter cylindrical cavity to define a sealed gas containing space above said plunger; and e. valve actuating means operatively associated with said inlet valve for actuating said valve to its open position at the desired time in a direction away from said cylinder and against the combined resistances of said valve closing spring and the gas compressed in the said gas space above said plunger and for releasing said valve to be actuated to its closed position at the desired time by the combined forces of said spring and said compressed gas, said actuating means including a rotary cam means driven in a predetermined timed relation with said machine and a pivotally mounted rocker arm means operatively associated with said cam and said valve.

8. The improved inlet valve arrangement recited in claim 7 also including an annular plate carried by said valve stem within and near the bottom of said first cylindrical cavity when said valve is in said closed position, said annular plate having a diameter smaller than the inside diameter of said first cylindrical cavity and defining an annular metering passage therewith and being operative to provide damping of the impact of the closing of said inlet valve.

9. The improved inlet valve arrangement recited in claim 8 wherein said valve spring is disposed between the top of said first cylindrical cavity and said annular plate so that said spring is compressed when said valve is actuated to the open position.

10. The improved inlet valve arrangement recited in claim 7 including means for supplying gas under pressure to said first cylindrical cavity, said pressurized gas also being forced along said valve stem to provide cooling thereof and to prevent the fluid being supplied to said cylinder from flowing upward along said valve stem.

11. The improved inlet valve arrangement recited in claim 9 including passage means interconnecting said first and second cylindrical cavities and check valve means operatively associated with said passage means operative to allow flow of gas from said first to said second cylindrical cavity whenever the pressure in said second cavity is less than the pressure in said first cavity.

* * * * *